United States Patent [19]

Koontz

[11] 4,222,170

[45] Sep. 16, 1980

[54] SEGMENTAL TECHNIQUE FOR SIZING GARMENTS

[76] Inventor: Kathleen B. Koontz, P.O. Box 27062, Denver, Colo. 80227

[21] Appl. No.: 961,631

[22] Filed: Nov. 17, 1978

[51] Int. Cl.[3] ..... A41H 3/00

[52] U.S. Cl. ..... 33/17 R; 33/14; 33/17 A

[58] Field of Search ..... 33/17 R, 2 R, 11, 12, 33/14, 16, 17 A

[56] References Cited

U.S. PATENT DOCUMENTS

| | | | |
|---|---|---|---|
| 1,783,004 | 11/1930 | Smith | 33/14 |
| 3,745,656 | 7/1973 | Sweeney | 33/17 A |
| 3,979,831 | 9/1976 | Lutz | 33/17 R |

*Primary Examiner*—Willis Little

*Attorney, Agent, or Firm*—John R. Ley

[57] ABSTRACT

Pattern pieces of a conventional foundation pattern draft are divided into segments along predetermined division lines. Various segments of different overall sizes are joined together and form a new pattern piece. The segments selected for combination into the new pattern piece more precisely fit and accommodate major fitting and structural areas of the body. Adjustment lines are marked on various segments forming the pattern piece. Dividing the pattern piece along the adjustment lines and overlapping the resulting edges of separating the resulting edges or horizontally shifting one resulting piece from another achieves vertical and horizontal adjustment in the pattern piece. A transfer technique involving angular pivotation of one defined portion or sector of the new pattern piece with respect to the remaining portion of the pattern piece in conjunction with other adjustments achieves further adjustment and precise fitting of the pattern piece.

10 Claims, 13 Drawing Figures

44
37
34
45
43
26
22
46
38
36
15
48
39
28
39
50
42
24
24
30
40
40
41
20

44'
37'
26'
43'
34'
22'
38'
46'
15
36'
28'
48'
42'
50'
39'
30'
24'
24'
41'
40'
40'
52

66
56
36'
63
64
15
54
36
60
68
15
57
70
72
15
61
58
62

76
40
40
41
89
89
78
84
80
90
88
86
87
15
82
92
94

Fig_8
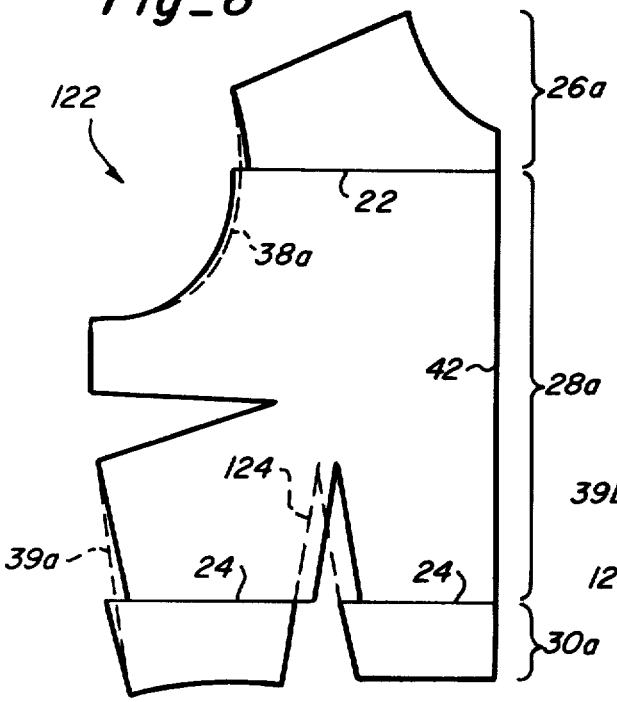
Fig_9
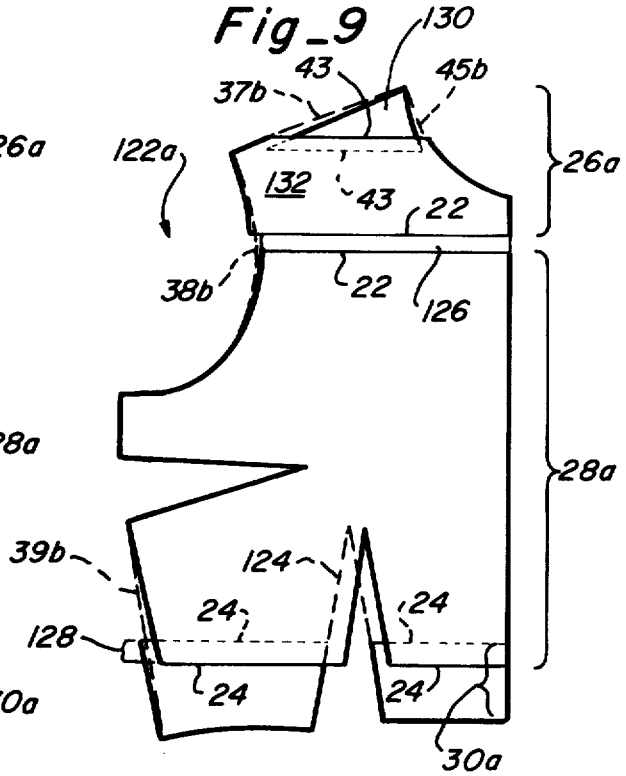
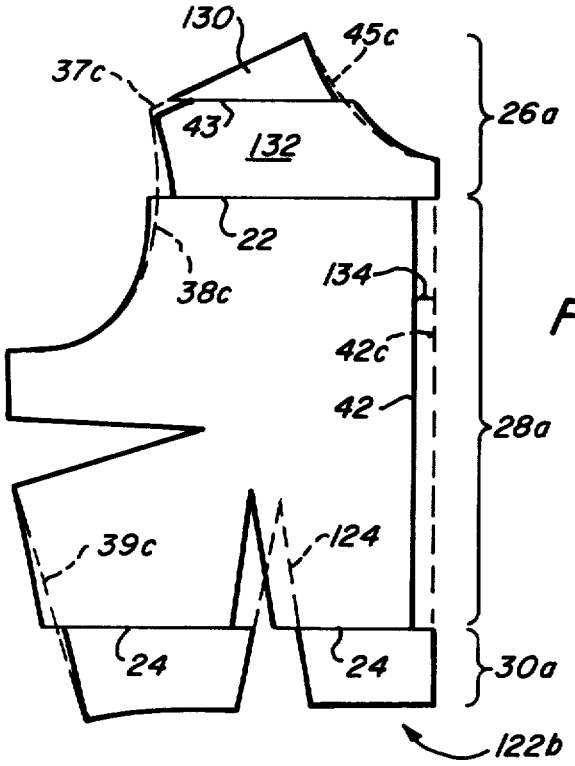
Fig_10

SEGMENTAL TECHNIQUE FOR SIZING GARMENTS

BACKGROUND OF THE INVENTION

1. Field of the Invention

This invention broadly relates to garment making by use of garment patterns, and more specifically to a technique for precisely and individually sizing a garment pattern through the combination, arrangement and adjustment of specifically defined segments and portions of conventional pattern pieces.

2. Brief Introduction and Description of Prior Art

It is conventional practice to use garment fitting patterns in sewing garments. The garment fitting patterns are supplied in various selected overall sizes, for example, ranging from size 3 to size 60. The user selects the size that most generally fits or accommodates the whole of the person's body for whom the garment is intended. While the individual's overall stature is accommodated by a pattern of one size, certain major fitting and structural areas of the body may not be properly accommodated by the selected single-size pattern. For example, the bust size and the waist size may not be in the proportion provided by a single pattern size. Furthermore, the posture of the individual influences the garment fit in certain portions of the figure. As a result, one or more fitting areas usually not accurately fitted by the garment formed from the pattern of one selected size.

Attempting to randomly alter a conventional single-size pattern in one or more areas may create new or previously non-existing fitting problems in other areas, because the pattern outline as a whole is proportionally interrelated. Consequently, random alteration of one area can potentially adversely affect the fitting and sizing in another area. Another problem in attempting to alter a conventional garment pattern is that most users do not know the areas of the pattern to alter to achieve a specific fitting change, or the manner of altering the garment pattern to achieve a desired effect. Other than to accommodate the body of a person as a whole, conventional garment patterns do not consistently allow precise fitting in the major areas where structural, fitting and sizing problems typically occur and where special fitting is most commonly needed.

Conventional garment fitting patterns usually create a garment possessing only one overall fashion style or design, and a new pattern must be purchased to obtain each different fashion design. While one overall style might be appealing to some users, certain portions of a garment style may not be appealing or desirable to other users. The users may wish to use only the appealing portion of the design while discarding the remaining portion. Selective use of the design portions of various different patterns is not conveniently accomplished because some design features are not defined separately of the remaining portion of the garment pattern. Some users would experience significant difficulty in separating a given design portion from a conventional garment pattern, and most users would not be able to do so at all. Even if such separation could be conveniently accomplished, great difficulty would be experienced in determining how and where to combine the various randomly separated portions without adversely affecting the proportion, size, overall fit and design of the garment formed by the garment fitting pattern.

While this discussion generally introduces certain significant considerations applicable to the prior art, those limitations and considerations should become more apparent upon recognition of the substantial advantages, features and concepts involved in the present invention.

3. Objectives of the Invention

It is the general objective of the invention to provide a garment fitting pattern for achieving individualized precise fitting of the garment formed by the pattern. Another objective is to arrange an existing garment fitting pattern for more precisely accommodating major fitting areas of individual human figures. A further objective is to provide garment fitting patterns in specific defined segments and in different segment sizes, to allow precise accommodation of the major fitting areas and to allow convenient combinations of the differently sized segments to form new elements of a garment fitting pattern. Still a further objective is to allow separate segments of garment fitting patterns to be selectively combined for achieving various new, different and individualized style and fashion designs. Another objective is to teach a technique for solving problems of design and fitting in certain areas, which allows each fitting problem to be solved independently of other fitting and styling problems in other areas of the garment. Still another object is to avoid the necessity for purchasing a complete pattern each time a new and different fashion design in a garment is desired. Lastly, a further objective is to achieve a precise fitting of the garment in all major body fitting areas including those areas in which complexity in fitting a pattern is commonplace.

SUMMARY OF THE INVENTION

In accordance with these and other objects and aspects of the invention, the elements or pattern pieces of a garment foundation pattern draft are divided into predetermined segments. The segments are defined by division lines which extend perpendicularly with respect to a vertical reference on the pattern pieces and also extend transversely between marginal outlines of the basic pattern pieces. The garment foundation pattern draft includes a bodice front, a bodice back, a sleeve, a skirt front, a skirt back, a pants front, and a pants back.

One or more of the various segments are separated from the pattern pieces, or otherwise individually provided, and selected segments are joined together to form new pattern pieces. The segments to be joined into the new pattern piece are selected to fit and accommodate major fitting and structural areas of the body. To accommodate vertical height and horizontal width requirements, adjustment lines are marked on selected segments. The adjustment lines extend essentially parallel to the division lines, or some division lines may also serve as adjustment lines. Vertical height adjustment is achieved by separating the new pattern piece along the horizontal adjustment lines and vertically overlapping or spacing the separated pieces by an amount equal to the degree of height adjustment desired. Horizontal width adjustment is achieved by horizontally shifting one or more of the separated portions with respect to another portion by the desired amount.

A further feature of the invention relates to transferring material in an angular or non-perpendicular sense from one area of the new pattern piece to another area. The transfer technique involves selecting a beginning point and drawing at least two intersectably angling transfer lines from the beginning point to the marginal outline of the new pattern piece or of one of the segments. Thereafter, the new pattern piece or segment is separated along the transfer lines. The pattern sectors resulting from separation along the transfer lines are then, in effect, pivoted with respect to one another about the beginning point which remains intact. This pivoting technique can remove excess material in one area of the garment by overlapping the material along the transfer lines and angularly transferring material to another area where it is needed. Angular transfer can be applied in the manner most appropriate for precise fitting. New marginal definitional lines are interpolated at points and through areas where various joined segments have been connected.

A more complete understanding of the invention can be obtained from the appended claims, and from the detailed description of preferred embodiments taken in conjunction with the drawing consisting of a number of figures.

BRIEF DESCRIPTION OF THE DRAWINGS

FIGS. 1 through 7 illustrate the position and marking of division lines and adjustment lines on the pattern pieces in accordance with concepts of the present invention.

FIG. 8 is a general illustration according to the invention of dividing pattern pieces along division lines into segments, combining or joining segments of differently sized pattern pieces and interpolating a new marginal outline to form a new pattern piece.

FIG. 9 is a view similar to FIG. 8 which illustrates a method by which various height or vertical adjustments in the new pattern pieces are accomplished by use of the adjustment lines.

FIG. 10 is a view similar to FIG. 8 which illustrates a method by which width or horizontal adjustments in the new pattern pieces are accomplished by horizontally shifting segments or portions of segments with respect to one another along the adjustment lines.

DESCRIPTION OF PREFERRED EMBODIMENTS

Figure 1:
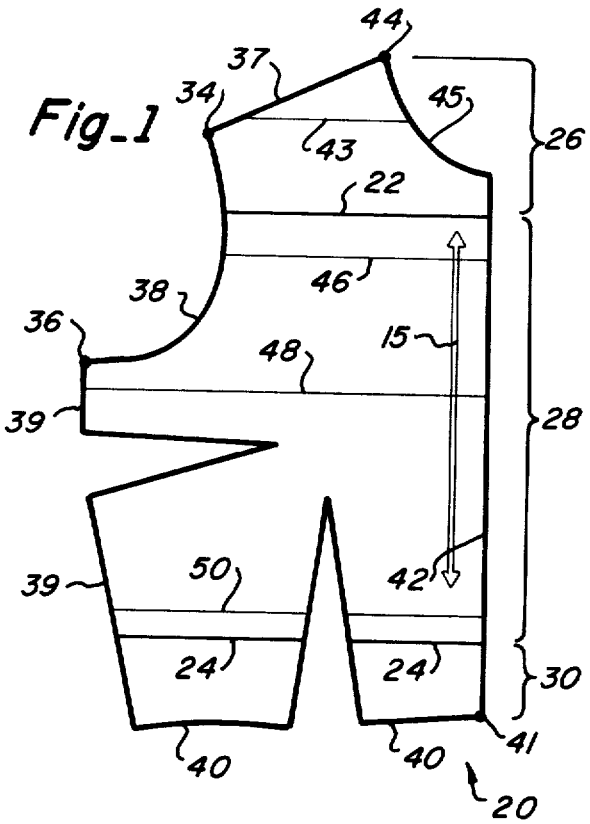
FIGS. 1 through 7 generally illustrate the marginal outlines of the elements or conventional pattern pieces which cooperatively define a garment foundation pattern draft. More specifically, FIGS. 1 through 7 respectively represent the pattern pieces of a bodice front, a bodice back, a sleeve, a skirt front, a skirt back, a pants front and a pants back. In addition.

The present invention relates to a conventional foundation pattern draft for a garment and for all patterns derived from conventional pattern drafts. The pattern draft comprises a number of known and recognized elements or pattern pieces illustrated in FIGS. 1 to 7. Pattern drafts are available in a number of predetermined overall sizes, typically ranging from size three to size sixty. The dimensions and proportion of each pattern piece change in accordance with the overall size of the foundation pattern draft of which the pattern piece is a part. However, with changes in size, the pattern pieces retain their general overall shape, configuration and proportion.

The foundation pattern draft comprises the following pattern pieces: a bodice front, a bodice back, a sleeve, a skirt front, a skirt back, a pants front, and a pants back, respectively illustrated in FIGS. 1 to 7. One aspect of the present invention relates to dividing the pattern pieces into a plurality of segments. Each of the segments of each pattern piece is defined by division lines which are marked or extend in predetermined locations and positions on each pattern piece. Segments from at least two different sized pattern pieces are combined to form a new pattern piece, and the new pattern piece provides a more specifically and accurately sized pattern by which a better fitting garment can be formed.

The division lines have been located to define predetermined segments which accommodate major fitting and structural areas of the body. Each segment has been designed to accommodate the human structural framework within the major fitting area. It has been determined that the human figure within each of these major fitting areas can generally be adequately approximated by one predetermined segment from a single size pattern. The selected size segments thus accommodate each fitting area as a part of the overall pattern. The division lines have been located in predetermined positions to allow convenient selective combinations of different sizes of segments into the overall garment pattern without creating fitting and sizing problems in other areas. The segments are also of size for individually presenting whole or major parts of various different fashion styles and designs into the garment, independently of the fashion style or design of the remainder of the garment. The result of combining the segments is a more accurately fitting garment having a possible fashion design unique to its maker.

Adjustment lines are marked or located on at least some of the segments defined by the division lines on the pattern pieces. The division lines can also function as adjustment lines. The segments can be separated or cut at the adjustment lines, and the pieces overlapped, separated or shifted to adjust the overall vertical height or horizontal width of the segment and the new pattern piece. The adjustment lines thereby allow further refinements in height and width proportion in the new pattern piece as a whole.

Lastly, a technique of transferring material in sectors from one pattern location to at least one other pattern location is taught. Transfer is effected angularly with respect to a central or beginning point on the new pattern piece. Transfer lines are marked from the beginning point outwardly to the marginal outline of the pattern piece or segment. The pattern piece is divided into sectors along the transfer lines. One of the resulting sectors is angularly oriented with respect to the other sector by, in effect, pivoting one of the sectors about the central point and operatively connecting the pivoted sector into the pattern piece.

A more perfect garment fit is thus achieved by selecting various segments of the pattern pieces for combination into a new pattern pieces. Each of the segments is selected to more precisely accommodate a major fitting and variable size structural framework area of the human figure. The selected segments are connected together and horizontal width and vertical height and angular transfer of material from one angular sector to another achieves the final adjustments.

The concepts of the present invention can be better understood after the location of the division, adjustment and transfer lines is explained in the following description. The invention is illustrated with reference to basic foundation pattern pieces, but it is understood that the concepts of the invention are applicable to all pattern pieces which may originate from the basic foundation pattern pieces. A convention applied in conjunction with the drawing in describing the invention is that of using the terms "up" or "down", or similar terms or formatives of these terms, to define positional relationships respectively toward the top and toward the bottom of each of the drawing figures, which illustrate the upper portions of the patterns at the top of each FIGURE. The basic pattern pieces are illustrated by marginal outlines. It should be recognized that the marginal outlines are conventionally known as stitching lines. As is also conventionally recognized, a seam allowance of material (not shown) is allowed exteriorally of the marginal outlines of the pattern pieces when the pieces of garment material are cut. Also, each pattern piece includes a vertical reference mark or guide 15 thereon. Typically, the vertical reference guide 15 will be a vertical grain line indicator or a center line. All division and adjustment lines intersect perpendicularly or extend perpendicularly with respect to, the vertical references 15. Thus the division and adjustment lines are parallel to one another. The division and lines adjustment lines extend between opposite transverse marginal outlines of the pattern pieces.

A bodice front pattern piece 20 is illustrated in FIG. 1. An upper division line 22 and a lower division line 24 are marked or otherwise utilized to divide the bodice front 20 into an upper segment 26, a middle segment 28, and a lower segment 30. The upper division line 22 is marked and located between a point 34 known as the tip and a point 36 known as the scye reference. The tip 34 is the junction point of a shoulder line 37 and an arm hole line 38. The scye reference 36 is the junction point of the arm hole line 38 and the outside marginal outline 39 of the pattern piece 20. The upper division line 22 is positioned downward from the tip 34 by an amount dependent upon the vertical distance between the tip 34 and the scye reference 36. For each size of bodice front pattern piece 20, the upper division line 22 will lie downward from the tip 34 a distance within the range of one-fourth to one-half of the vertical distance between points 34 and 36. Preferably, the upper division line is positioned downward from the tip 34 approximately one-third the vertical distance between points 34 and 36. The lower division line is marked and located with respect to a natural waistline reference 40 and the junction at point 41 of the natural waistline reference 40 and a center vertical line 42. The point 41 is known as the center waistline reference point. For each given size of the bodice front pattern piece, the lower division line 24 is positioned within the range of approximately 2½ to 4 inches above the center waistline reference point 41. Preferably the lower division line 24 will be positioned three inches above the center waistline reference point 41.

An adjustment line 43 is marked on the upper segment 26. The adjustment line 43 is positioned to intersect the shoulder line 37. Thus, the adjustment line 43 extends through the shoulder line 37 between the shoulder armhole junction 34 and a shoulder neckline junction 44. The shoulder neckline junction 44 is the junction of the shoulder line 37 and a neckline 45. Preferably, the adjustment line 43 is positioned within a range of from one-half inch to one inch above the shoulder armhole junction 34. Preferably, three adjustment lines 46, 48 and 50 are provided on the middle segment 28. The upper adjustment line 46 is positioned approximately in the range of from one inch to two inches below the upper division line 22. The adjustment line 48 falls within the range of one inch to two inches below the scye reference 36. The adjustment line 50 is positioned between adjustment line 48 and division line 24, or can be positioned on the lower segment 30. The exact location of the adjustment line 50 should be compatible with the garment design defined by the bodice front. A specific adjustment line is not marked on the lower segment 30, since some adjustment will be available at the division line 24 as will be explained.

Figure 2:
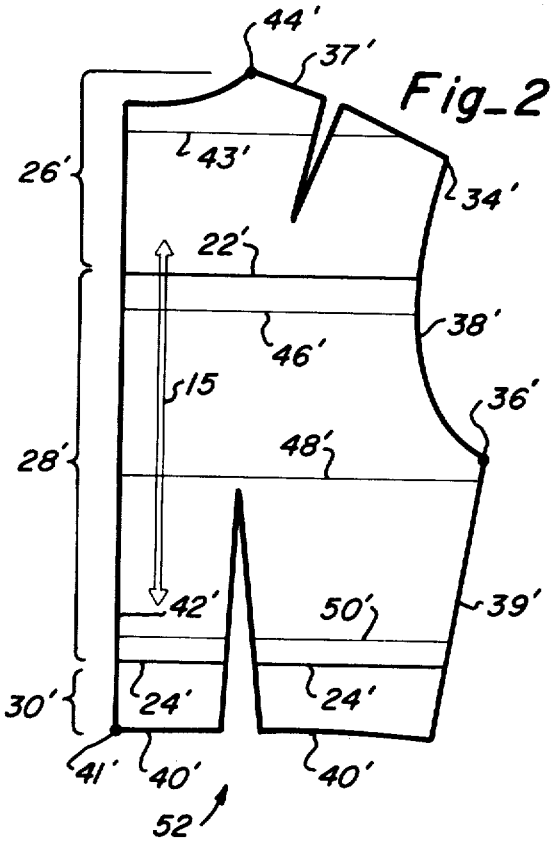

A bodice back pattern piece 52 is illustrated in FIG. 2. Of course, the bodice back 52 includes reference points similar to those defined on the bodice front. The similar points, lines and segments on the bodice front and bodice back are referenced by ordinary reference numerals in FIG. 1 and primed reference numerals in FIG. 2. The bodice back 52 includes division lines 22' and 24', which are positioned in the same locations with respect to primed reference points as division lines 22 and 24 are positioned with respect to corresponding non-primed reference points on the bodice front 20 shown in FIG. 1. The division lines 22' and 24' divide the bodice back 52 into an upper segment 26', a middle segment 28', and a lower segment 30'. The bodice back 52 also includes adjustment lines 43', 46', 48' and 50' which are marked and extend in the same location as adjustment lines 43, 46, 48 and 50 respectively, described on the bodice front 20.

Figure 3:
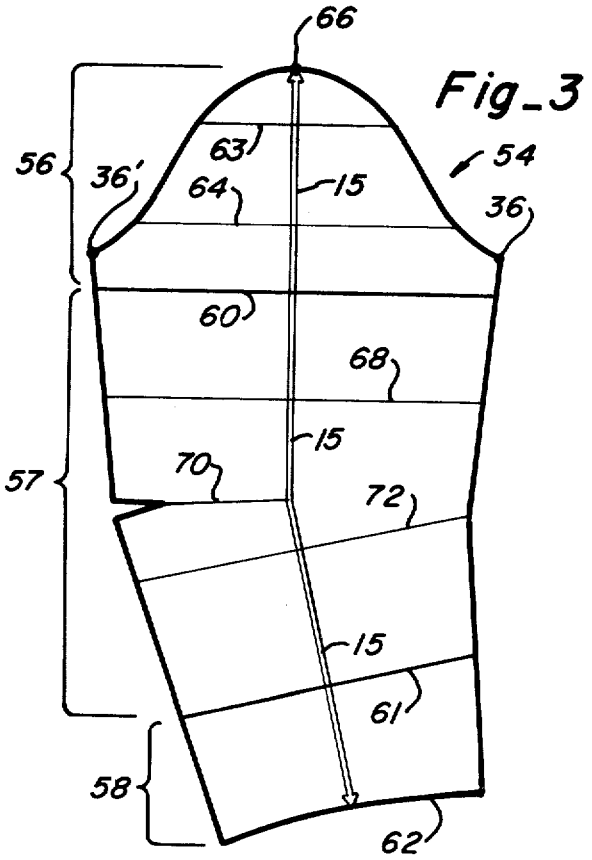

A sleeve pattern piece 54 is illustrated in FIG. 3. The sleeve 54 is divided into an upper segment 56 known as a sleeve cap, a middle segment 57 and a lower segment 58 by division lines 60 and 61. The division line 60 is positioned approximately one to two inches below the scye reference 36 and 36' indicated on opposite transverse sides of the upper segment 56. The division line 61 is positioned approximately five inches above a wrist level reference 62 near the transverse center of the lower portion of the sleeve segment 8.

Two adjustment lines 63 and 64 are marked or provided on the upper segment 56 of the sleeve piece 54. The adjustment lines 63 and 64 are positioned proportionately with respect to the overall vertical height of the upper segment 56 between division line 60 and a shoulder sleeve junction 66. The shoulder sleeve junction 66 very nearly coincides with the shoulder armhole junction 34 illustrated in FIGS. 1 and 2. Adjustment line 63 is positioned within the range of one-fourth to one-third of the vertical height downwardly from the shoulder sleeve junction 66. The second adjustment line 64 is positioned within the range of two-thirds to three-fourths of the distance downwardly from the shoulder sleeve junction 66. An adjustment line 68 is positioned between an elbow reference level or mark 70 and the division line 60. The elbow reference level 70 is typically marked on the conventional sleeve piece 54. Preferably, the adjustment line 68 extends through the vertical reference 15 at a point approximately half way vertically between the points where the elbow level 70 and upper division line 60 intersect the vertical reference 15, the vertical reference 15 being approximately at the transverse center of the sleeve piece 54. Adjustment line 72 is positioned between the elbow reference 70 and the lower division line 61. It is known that the lower portion of the vertical reference 15 changes angle at the elbow reference 70 and extends from the elbow level to the wrist level reference 62 at an angle with respect to its upper portion extending from the elbow level 70 to the shoulder sleeve junction 66.

Figure 4:
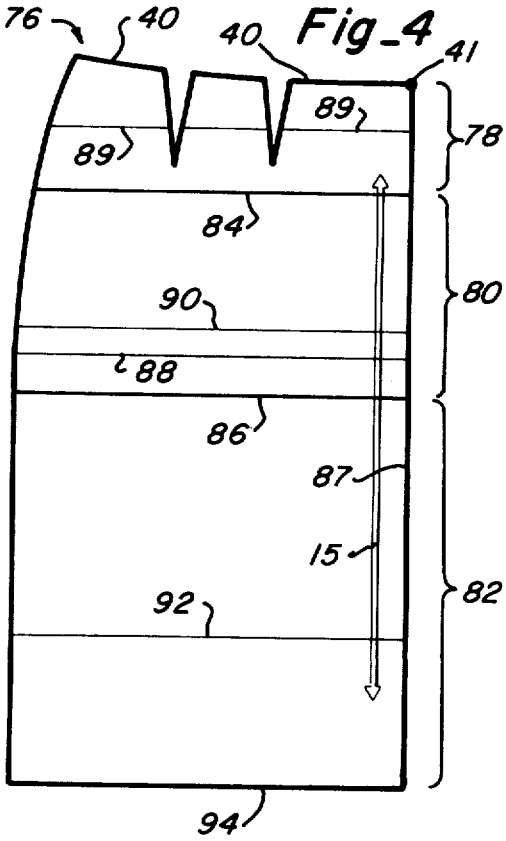

A skirt front pattern piece 76 is illustrated in FIG. 4. The skirt front pattern piece is divided into an upper segment 78, a middle segment 80 and a lower segment 82 by an upper division line 84 and a lower division line 86. The upper division line 84 is positioned approximately within the range of three to five inches below the center waistline reference 41, which is the intersection of the natural waistline reference 40 and a center vertical line 87 of the skirt pattern piece 76. The lower division line 86 is positioned approximately within the range of eleven to fourteen inches below the center waistline reference 41, and below a hip level reference 88 conventionally marked on the pattern piece 76. The upper segment 78 includes one adjustment line 89 positioned vertically spaced between, preferably half-way, the center waistline reference 41 and division line 84. The middle segment 80 includes one adjustment line 90. The adjustment line 90 is preferably positioned between the hip level reference 88 and the division line 84. An adjustment line 92 is positioned between the lower division line 86 and a hem or finished length reference line 94.

Figure 5:
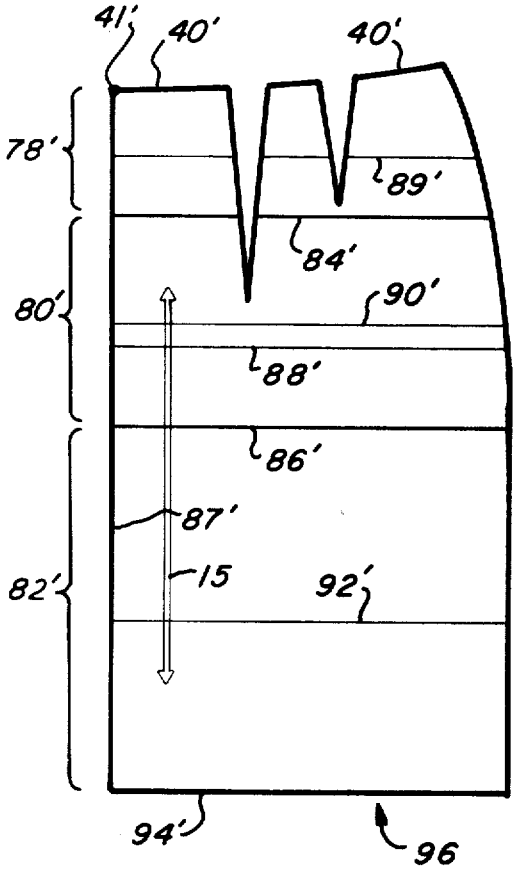

A skirt back pattern piece 96 is illustrated in FIG. 5. The skirt back piece 96 is divided into an upper segment 78', a middle segment 80' and a lower segment 82' by division lines 84' and 86'. Adjustment lines 89', 90' and 92' are respectively provided in the upper, middle and lower segments 78', 80' and 82'. The positions of the division and adjustment lines are the same as has been described for lines on the skirt front pattern piece 76 referenced by corresponding non-primed reference numerals.

Figures 6, 7:
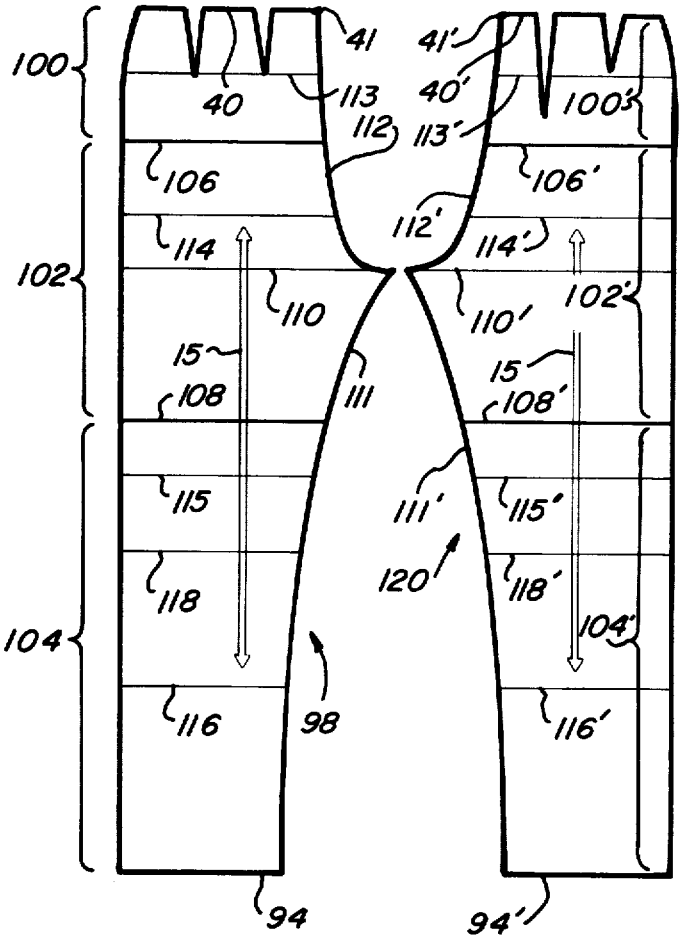

A pants front basic pattern piece 98 is illustrated in FIG. 6. The pants front piece 98 is divided into an upper segment 100, a middle segment 102, and a lower segment 104 by division lines 106 and 108. The upper division line 106 is positioned within the range of three to five inches below the center waistline reference 41. The lower division line 108 is positioned with respect to a crotch reference 110 conventionally marked on the pattern piece 98. The crotch reference 110 extends through the point on the transverse side where the inseam 111 of the leg portion contacts the curved arcuate portion 112 extending to the natural waistline 40. The lower division line 108 is positioned approximately six inches below the crotch reference 110. The upper segment 100 is marked with a single adjustment line 113, which is located between division line 106 and the center waistline reference 41. The middle segment 102 is preferably marked with a single adjustment line 114. The adjustment line 114 is positioned between the division line 106 and the crotch reference 110. The lower segment 104 is preferably marked with two adjustment lines 115 and 116. The upper adjustment line 115 lies between a knee level reference 118 typically marked on the pattern piece 98 and the lower division line 108. The lower adjustment line 116 is positioned intermediate the knee level reference 118 and the finished length reference 94.

A pants back basic pattern piece 120 is illustrated in FIG. 7. The pants back pattern piece 120 is divided into an upper segment 100', a middle segment 102', and a lower segment 104' by division lines 106' and 108'. In addition, adjustment lines 113', 114', 115' and 116' are provided. The position of the division lines and the adjustment lines on the pants back pattern piece 120 is the same as has been described for the lines indicated in FIG. 6 referenced by corresponding non-primed reference numerals.

Use of the segments of pattern pieces defined by the division lines, and adjustments obtained by the adjustment lines will be explained in conjunction with FIGS. 8 to 12. The formation of a new pattern piece by combining various segments divided from differently sized pattern pieces is illustrated in FIG. 8. A new bodice front pattern piece 122 is illustrated but the same technique is applied to all of the pattern pieces described. The new pattern piece 122 is formed from at least one segment of a bodice from pattern piece which is of a different size than at least one of the other segments of the new pattern piece 122. For example, an upper segment **26*a* of the new bodice front pattern piece 122 may have been obtained from a size 6 bodice front pattern piece. A middle segment 28*a* may have been obtained from the middle segment of a size 10 bodice front pattern piece. A lower segment 30*a* may have been derived from the lower segment of a size 12 bodice front pattern piece. The selected segments 26*a*, 28*a*, and 30*a* are joined together at the division lines 22 and 24. Horizontal adjustment of the segments with respect to one another positions the marginal outline defining the center vertical line 42 of the whole pattern piece 122 in alignment. The opposite transverse marginal outline is slightly disjointed at the division lines 22 and 24 due to the different sized segments. To alter the disjointed condition, a new marginal line 39*a* and armhole 38*a* are interpolated in the areas of the division lines. A new dart 124 is also interpolated. The interpolated lines are marked on the joined together pattern segments. It may be necessary to provide backing material in certain areas over which the interpolated lines can be marked. The areas of interpolation are indicated with dotted lines at 39*a*, 38*a* and 124 in FIG. 8**.

Vertical height adjustment provided by the adjustment lines is describing conjunction with FIG. 9, wherein a new bodice front pattern piece **122*a* is illustrated. The new bodice front pattern piece is formed by the same segments 26*a*, 28*a* and 30*a*, as have previously been described in FIG. 8. It should be recognized that the vertical height adjustment can be obtained with segments from a single sized pattern piece, as well as with segments of different sizes. It should also be noted that either division or adjustment lines can be used to obtain vertical height adjustments in this sense since the division lines can also function as adjustment lines. In general, the vertical height adjustment involves separating the pattern piece or segments along adjustment lines and spacing the separated parts at the edges or overlapping the separated parts at the edges of the adjustment line. The separated and spaced apart segments 26*a* and 28*a* illustrate an example of adjusting the segments to provide increased vertical height. An insert of material 126 is placed between the division lines 22 (functioning as adjustment lines) so that the edges of division lines on the segments 26*a* and 28*a* are parallel and spaced apart. As a result, the segments 26*a* and 28*a* are vertically spaced by an amount equal to the width of the insert 126, thus providing increased vertical height adjustment. Two examples of adjustment to obtain reduced vertical height are illustrated in FIG. 9. The first example involves the overlapping of the separated segments 28*a* and 30*a* along the division line 24** (functioning as an adjustment line). The amount of overlap, designated 128, achieves a reduction in overall vertical height between segments 28*a* and 30*a*. The second example involves use of an adjustment line 43 on the upper segment 26*a*. The upper segment is divided into two parts 130 and 132 by cutting or separating the segment 26*a* along the adjustment line 43. Thereafter, part 130 is overlapped with respect to part 132. The edges defined by the adjustment line 43 are positioned parallel and overlapped with respect to one another. Thereafter, the upper part 130 is joined to the lower part 132. After the foregoing vertical height adjustments have been achieved, new marginal outlines are interpolated. Due to the reduction in height caused by overlapping the parts 130 and 132 of the upper segment 26*a*, a new shoulder line 37*b* and neckline 45*b* are interpolated. A new armhole line 38*b* is interpolated between spaced apart segments 26*a* and 28*a*. Again, a new marginal outline 39*b* and dart 124 are interpolated between the segments 28*a* and 30*a*.

Illustration of the use of the adjustment lines to secure horizontal width adjustments within a pattern piece is illustrated in FIG. 10. The pattern piece 122*b* shown in FIG. 10 is comprised of segments 26*a*, 28*a* and 30*a* all of the same size pattern piece, although the horizontal width adjustment technique can also be applied when combining segments of different sizes. The objective is to provide more width over the major fitting and structural area covered by the middle segment 28*a*. To obtain this increased width, the middle segment is cut or divided along the division lines 22 and 24 (functioning as adjustment lines). The segment 28*a* is thereafter shifted by moving the original vertical line 42 outward (to the left in FIG. 10) from the new central vertical line 42*c* by an amount 134 equal to the amount of vertical width increase desire for half of the garment. The segments 26*a*, 28*a* and 30*a* are joined along the division lines 22 and 24 after the middle segment 28*a* has been shifted. A new center vertical line 42*c* is interpolated on an insert of material between the center vertical edges of segments 26*a* and 30*a*. Another objective is to provide increased width in the upper portion of the upper segment 26*a*. To achieve the increased horizontal width, the upper segment 26*a* is cut or divided along adjustment line 43. The resulting upper part 130 is horizontally shifted outward (to the left in FIG. 10) with respect to the center vertical line 42*c*. Thereafter the upper parts 130 and 132 are connected together along the edges of the adjustment line 43. After the horizontal width adjustments have been made, new marginal outlines are interpolated, including new portions of the armhole 38*c*, the shoulder line 37*c*, the neckline 45*c*, the marginal outline 37*c* and a dart 124.

Although the foregoing description in conjunction with FIGS. 8–10 has illustrated combining segments and achieving height and horizontal width adjustments independently of one another, the described techniques can be applied in combination with one another to achieve the overall effect desired by the user.

A further adjustment technique involves transferring a sector or a diverging pattern part with respect to the remaining pattern part of a new pattern piece or of a selected segment of a new pattern piece. This transference technique provides additional refinement and adjustment over the vertical and horizontal adjustment techniques previously described and over that secured by combining different sized segments of pattern pieces. The transference technique precisely accommodates depth and thickness in the garment, and is particularly useful for accommodating sizing, curvature and depth in the curved areas of the bodice front and back and the skirt and pants back pattern pieces. Thus, the transference technique is particularly useful for accommodating depth and angular variations within the curved areas primarily of the neck, shoulders, armhole, bust, chest, back, waist, hips and crotch major fitting and structural areas of the body.

Figure 11:
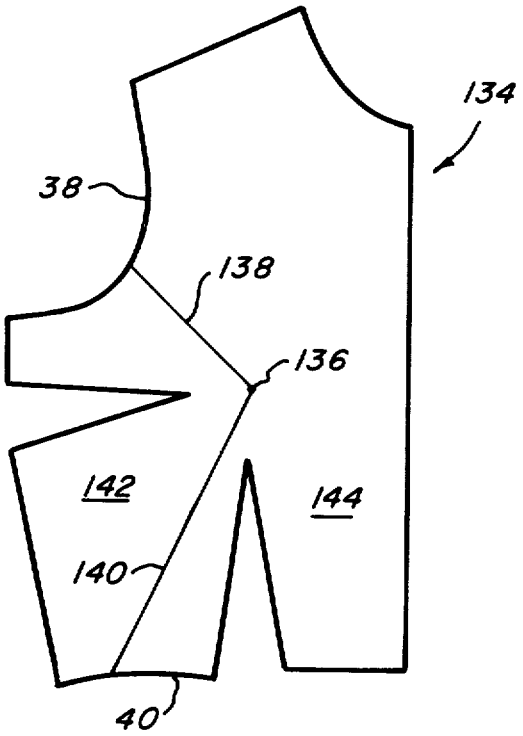
FIGS. 11, 12 and 13 are schematic illustrations of a bodice front to which a technique for transferring material from one area of the pattern piece to another area or areas of the pattern piece is accomplished by use of transfer lines formed on the new pattern piece or on a segment of a pattern piece.
Figure 12:
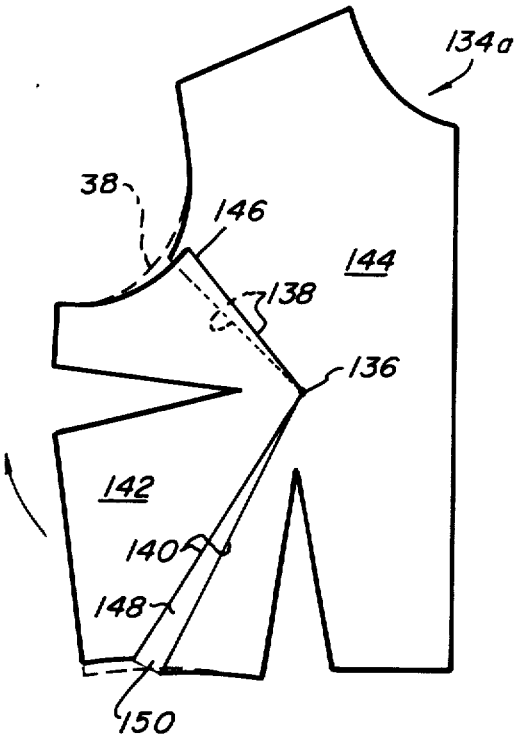

FIG. 11 illustrates use of the transference technique in conjunction with a new bodice front pattern piece 134. In this case, the transference technique is applied only after the selected segments have been joined together and after the vertical height and horizontal width adjustments have been accomplished. A beginning point 136 is selected at a point spaced inwardly from the marginal outline of the pattern piece 134. The beginning point 136 is selected by the effect to be achieved, in relation to the fashion design of the resulting garment and through the skill and experience of the user. The beginning point determines the amount of pattern material which is to be transferred by the resulting angular relationships of the sectors. A first straight transfer line, for example 138, is marked from the beginning point 136 to a point on the marginal outline of the pattern piece. The point or position on the marginal outline to which the first transfer line 138 is marked is selected to be an area where material is to be added or removed. In the example shown the first transfer line 138 extends to the armhole 38, it being assumed that the armhole area contains an excessive amount of material which will be removed. A second straight transfer line, for example 140, is marked from the beginning point 136 to a position on the marginal outline where it is desired to add the excessive material or remove the excessive material. The pattern piece 134 is cut inwardly from the outer marginal area along the transfer lines 138 and 140 to within a short distance of the beginning point 136. Essentially the pattern piece 134 is divided into two portions 142 and 144. The relative positional relationship of the portions 1412 and 144 is adjusted by angularly pivoting one of the portions, for example 142, about the beginning point 136 in an effective direction to achieve the desired result. In the example given, as shown in FIG. 12, the portion 142 is pivoted clockwise so as to create an overlapping sector 146 between the intersectably angling edges of transfer line 138. Creating the overlapping sector 146 has the effect of shortening the overall curvilinear length of the armhole line 38, and removing the excessive material from the sector 146. The edges along transfer line 138 are connected to the respective portions 142 and 144. From pivoting the open space sector 148 is defined between the intersectably angling and spaced apart edges along the cut transfer line 140. An insert 150 is positioned in the spaced apart sector 148 and the edges along transfer line 140 are attached to the insert 150. Since the transfer line 140 extends to the natural waistline 40, the amount of space between the edges of the transfer line 140 at the spaced apart sector 148 represents the amount of material added to the natural waistline. The overlapping edges defining sector 146 represent the material removed from the armhole. The material removed from the armhole is added to the natural waistline. After the transference has been accomplished, it may be necessary to interpolate new marginal outlines in the areas of the sectors.

One very effective use of the transference technique is to compensate for changes made in one pattern piece when its joining pattern piece has not been changed. For example, as understood from FIGS. 1 and 2, it may be necessary to increase the verticle height of the bodice back pattern piece 52 at adjustment line 50'. The bodice back 52 must join to the bodice front 20 along the marginal outline 39 and 39'. However the marginal outline 39' is longer than the outline 39 due to change at 50'. The transference technique can be used to shift excess material from the armhole 38 of the bodice front 20, for example, to the outline 39. As a result the marginal outlines 39 and 39' are now the same length, and the pattern pieces 20 and 52 are readily joined together.

It should be understood that any number of transfer lines and sectors can be created to divide the material between as many sectors as is needed to achieve the necessary effects. It should also be noted that the transference technique is considerably different than the well known darting technique employed in sewing pieces of material obtained from pattern pieces. The darting technique is merely and technique of forming the flat garment material into three dimensions by gathering the material and sewing along the dart lines. The transference technique is a procedure by which a portion of a pattern piece or segment can be articulated with respect to the remaining portion to redistribute material from one or more areas and to one or more other areas. Thus, the transference technique is a procedure by which the size and proporation of a pattern piece or segment of a pattern piece is adjusted. Other than to provide for an appropriately sized pattern for forming a garment piece which may be suitable itself for fitting over various curved areas, the transference technique does not directly involve the creation of darts so as to achieve a three dimensional effect in the material cut or obtained from the pattern piece. However, the transference technique can be used in conjunction with any existing dart or dart control factor (to transfer material into or out of the existing darts) or independently of the existing darts (as shown in FIG. 12) or through a combination of both.

Figure 13:
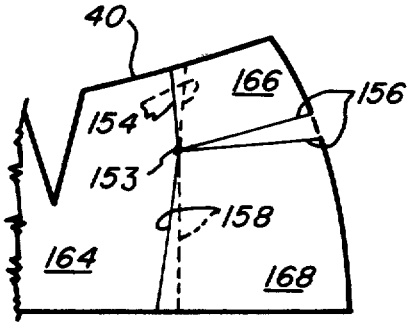

FIG. 13 illustrates use of the transference technique in altering the configuration of the upper segment of a skirt or pants pattern piece 152. A beginning point 153 is selected, and transfer lines 154, 156 and 158 are drawn respectively to the natural waistline 40, the outside transverse edge 162, and the upper division line 84 (or 84' or 106 or 106'). Cuts are made along the transfer lines and the resulting three portions 164, 166 and 168 are appropriately articulated to transfer the material from one or more areas to one or more of the other areas to which the transfer lines extend. After the appropriate adjustment of the pattern segment has been accomplished, that segment is combined with other segments in the manner described to achieve a new pattern piece.

In accordance with the foregoing description and principals of this invention, new pattern pieces are formed by combining segments which have been divided from conventional foundation pattern draft pieces. These segments have been defined by division lines which occupy predetermined locations that have been determined to most accurately accommodate given major fitting and structural areas of the body. The division lines and segments defined thereby have also been located in a predetermined position for minimizing the problems of combining various differently sized segments into a new pattern piece. Thus, each of the segments has been defined in a manner which most conveniently accommodates a major fitting and structural area at which individual changes of sizing are likely to occur. Each of the segments thereby attempts to most accurately accommodate individual variations within the area that it covers. The defined segments can be separately supplied so that the user can join them together to form the new pattern piece, after selecting segments of the appropriate sizes. Alternatively, conventional pattern pieces can be marked with the division lines so that the user can thereafter separate certain segments from the pattern by cutting along the division lines. The undersired segments are thereafter replaced by corresponding segments separated from the same pattern of a different size. The term "corresponding" as used herein applicable to segments means the same segment from pattern drafts of different sizes. For example, the upper segment 26 of a bodice front 20 of size 6 corresponds with the upper segment 26 of a bodice front of a size other than size 6.

The significance of the present invention can be better understood by the effects it achieves. With respect to the bodice front and bodice back, defining the upper segments 26 and 26' in the manner described achieves precise and individualized direct fitting in the major structural or fitting areas of the neck, shoulders, chest and arm holes. The upper segment indirectly initiates fitting in the areas of the bust, waistline and overall bodice length. Furthermore, a variety of different fashion designs can be achieved by utilizing different upper segments 26 and 26' in the bodice front and back pattern pieces. The major structural and fitting area of the chest, armholes, shoulders, bust and midriff is individually accommodated by the middle segments 28 and 28' of the bodice front and back pattern pieces. Appropriate lower segments 30 and 30' achieve individualized direct fitting in the area of the waistline. In addition to directly fitting the particular structrual area of the figure, each of the segments initiates indirect fitting of all of the areas and pattern segments below a given pattern segment. The adjustment line 43 appropriately positions the neck level and width relative to the shoulder level and width. Vertical adjustments obtained by adjustment lines 46 and 48 position the bust level and armhole appropriately in conformance with the individual's figure. Adjustment line 50 primarily compensates for adjustments achieved at adjustment lines 46 and 48. The three segments 56, 57 and 58 of the sleeve pattern piece 54 have also been predetermined to accommodate major fitting and structural areas of the arm and to allow selective integration of various fashion designs into portions of the sleeve. Variations in shoulder and arm thicknesses are accommodated by selecting a proper upper segment 56. Arm thicknesses and lengths are accommodated by the middle segment 57. The lower segment 58 accommodates variations in wrist thicknesses. Furthermore, the upper, middle and lower segments are primary areas of the sleeve where significant variations in fashion design can be achieved by varying the type of segment employed. Adjustment lines 63 and 64 achieve further fashion design effects in the sleeve cap area and also allow the amount of material contained within the sleeve cap to be precisely determined. The elbow reference 70 can be precisely positioned at the elbow level of the individual by adjustment at line 68. Adjustment at line 72 indirectly positions the length of the forearm and the sleeve without interfering with the wrist cuff design at segment 58. Adjustment line 72 thereby adjusts the finished length of the sleeve 62 to precisely fit the length of the individual's arm.

Three major fitting and structural areas of the lower portion of the body are accommodated by dividing the skirt front and back pieces and the pants front and back pieces into the upper, middle and lower segments. The upper segments accommodate variations in waistline and hip bone width and provide a certain amount of tapering to accommodate the area in and about the hips. The primary function of the middle segment is to precisely accommodate the very important and tedious fitting and structural area of the hips, where curvatures and sizes may vary widely in relation to waist sizes and leg sizes. Thus, the areas covered by the middle segment include the hips, abdomen, thighs and crotch. A primary use of the lower segments is in varying the overall fashion design of the garment covering the lower portion of the body, although the lower segments in the pants front and back pattern pieces can be varied to accommodate differences in leg thickness sizes. Lower segment variations can achieve different lengths in the skirts and pants and radically vary the fashion design. The function of the adjustment line in the upper segment of the skirt front and back pattern pieces and the pants front and back pattern pieces is to increase or decrease the height of the segment in relation to the prominence of the hip bones and abdomen. The hip level or the crotch level can be positioned exactly at the hip or crotch level of the person by use of the adjustment line in the middle segments. The adjustment lines 115 and 115' in the pants pattern piece are utilized to effectively position the knee level of the pants at the level of the individual. The lower adjustment lines on the lower segments are used primarily to position the finished length at the desired level near the foot. Note: In that above paragraph with respect to the middle section it directly affects fitting in the areas of the hip bones, abdomen, hips, thighs and crotch.

The arrangement of the present invention and the significant advantages provided by it have been described in detailed throughout the foregoing disclosure. It should be understood, however, that the specificity of the present disclosure has been made by way of example, and that changes in detail may be made without departing from the spirit of the invention.

I claim as my invention:

1. A method of forming individually and specifically sized garment patterns utilizing segments of pattern pieces of a foundation pattern draft, the foundation pattern draft having a plurality of recognized predetermined overall sizes and each of the pattern pieces of the foundation pattern draft being of a size identified by the overall size of the foundation pattern draft of which the pattern piece is an element, said method comprising:

dividing a plurality of the corresponding pattern pieces into a plurality of segments, the plurality of corresponding pattern pieces including pattern pieces of at least two different overall sizes, each segment being defined by at least one division line extending perpendicularly with respect to a vertical reference of the pattern piece;

selecting a number of segments necessary to form a complete new pattern piece, at least two of the segments selected for completing the new pattern piece being divided from corresponding pattern pieces of different overall sizes;

joining the selected segments together at division lines to form a new pattern piece with segments thereof derived from at least two pattern pieces of different effective sizes; and interpolating a new marginal outline for the new pattern piece in at least one area of the new pattern piece where two segments are joined together.

2. A method of forming individually and specifically sized garment patterns utilizing segments of pattern pieces of a foundation pattern draft, the foundation pattern draft having a plurality of recognized predetermined overall sizes and each of the pattern pieces of the foundation pattern draft being of a size identified by the overall size of the foundation pattern draft of which the pattern piece is an element, said method comprising:

marking at least one division line on a first and a second pattern piece, the first and the second pattern pieces being corresponding pattern pieces of the foundation pattern draft, the first pattern piece being derived from a foundation pattern draft of one overall size and the second pattern piece being derived from a foundation pattern draft of another overall size, the division lines being marked essentially perpendicularly with respect to a vertical reference of said first and second pattern pieces;

separating the first pattern piece into first and second segments by dividing the first pattern piece along the marked division line;

separating the second pattern piece into first and second segments by dividing the second pattern piece along the marked division line, the first and second segments in the first pattern piece corresponding respectively in positional relationship and configuration to the first and second segments in the second pattern piece;

joining the first segment of the first pattern piece with the second segment of the second pattern piece with the division lines on each segment parallel to one another to form a new pattern piece; and interpolating a new marginal outline for the new pattern piece in at least one area of the new pattern piece where the first and second segments are joined together.

3. A method as recited in claims 1 or 2 wherein the pattern pieces of the foundation pattern draft comprise at least one of a bodice front, a bodice back, a sleeve, a skirt front, a skirt back, a pants front and a pants back; and wherein at least one division line is marked on at least one of the pattern pieces approximately as follows:

(a) On the bodice front and the bodice back, in at least one of the two following locations:

(1) Through a point positioned downwardly from a tip reference point at a location within the range of one-fourth to one-half of the vertical distance between the tip reference point and a scye reference point, and (2) Through a point within the range of two and one-half to four inches above a center waisteline reference point;

(b) On the sleeve, in at least one of the two following locations:

(1) Through a point approximately in the range of one to two inches below a scye reference point, and (2) Through a point approximately five inches above a wrist level reference near the transverse center of the lower portion of the sleeve piece;

(c) On the skirt front and the skirt back, in at least one of the two following locations:

(1) Through a point within the range of three inches to five inches below a center waistline reference, and (2) Through a point within the range of eleven to fourteen inches below the center waistline reference and also below a hip level reference; and (d) On the pants front and the pants back, in at least one of the two following locations:

(1) Through a point within the range of three to five inches below a center waistline reference, and (2) Through a point approximately six inches below a crotch reference.

4. A method as recited in claim 3 wherein:

(a) Two division lines are marked on the bodice front and the bodice back, and each of the bodice front and bodice back is defined into an upper segment, a middle segment and a bottom segment by the two division lines;

(b) Two division lines are marked on the sleeve and the sleeve is defined into an upper segment, a middle segment and a lower segment by the two division lines;

(c) Two division lines are marked on the skirt front and the skirt back, and each of the skirt front and skirt back is defined into an upper segment, a middle segment and a bottom segment by the two divisional lines; and (d) Two division lines are marked on the pants front and the pants back, and each of the pants front and pants back is defined into an upper segment, a middle segment and a bottom segment by the two divisional lines.

5. A method as recited in claim 4 further comprising:

marking at least one adjustment line on at least one of the segments of at least one pattern piece, the adjustment lines being essentially parallel to and spaced from at least one of the division lines defining the segments.

6. A method as recited in claim 5 wherein the adjustment lines are marked on at least one of the segments of at least one of the pattern pieces as follows:

(a) On the upper and middle segments of the bodice front and the bodice back pattern pieces;

(b) On the upper and middle segments of the sleeve pattern piece;

(c) On the middle and lower segments of the skirt front and the skirt back pattern pieces; and (d) On the middle and lower segments of the pants front and pants back pattern pieces.

7. A method as recited in claim 6 wherein the adjustment lines are marked approximately as follows:

(a) One adjustment line is marked on the upper segment of the bodice front and the bodice back pattern pieces at a position within a range of from one-half inch to one inch above the tip reference point;

(b) Two adjustment lines are marked on the middle segment of the bodice front and the bodice back pattern pieces, one adjustment line being marked at a position within a range from one to two inches below the upper division line, and the other adjustment line being marked at a position within a range of one to two inches below the scye reference point;

(c) Two adjustment lines are marked on the upper segment of the sleeve pattern piece, the first adjustment line being marked at a position within a range of one-fourth to one-third of the vertical distance of the sleeve upper segment downward from a shoulder-sleeve reference point, and the second adjustment line being marked at a position within a range of two-thirds to three-fourths of the vertical distance of the sleeve upper segment downward from the shoulder-sleeve reference point;

(d) Two adjustment lines are marked on the middle portion of the sleeve piece, one adjustment line being marked between the upper division line and the elbow reference point, and other adjustment line being marked between the elbow reference point and the lower division line;

(e) One adjustment line is marked on the middle segment of the skirt front and the skirt back pattern pieces at a position between the upper division line and a hip level reference;

(f) One adjustment line is marked on the middle segment of the pants front and the pants back pattern pieces at a position between a crotch level reference and the lower division line of the pants middle segment; and (g) One adjustment line is marked on the lower segment of the pants front and the pants back pattern pieces at a position between the division line defining the upper position of the lower segment and above a position approximating the knee level position.

8. A method as recited in claim 7 further comprising:

cutting along at least one of the division or adjustment lines to form two parts of the pattern, vertically adjusting the two parts with respect to one another by vertically spacing the edges formed by the lines which was cut, operatively joining the two parts together, and interpolating a new marginal outline in the area where the two parts have been joined together.

9. A method as recited in claim 7 further comprising:

cutting along at least one of the division or adjustment lines to form two parts of the pattern, horizontally shifting one of the parts with respect to the other along the line which was cut, and operatively joining the two parts together, and interpolating a new marginal outline in the area where the two parts have been joined together.

10. A method as recited in claim 3 further comprising, with respect to at least one of the new pattern piece or the segments defined:

selecting a beginning point spaced inwardly of the marginal outline;

marking a first straight transfer line from the beginning point to the marginal outline;

marking a second straight line from the beginning point to the marginal outline;

cutting along both transfer lines to essentially form at least two sectors;

adjusting one of the sectors with respect to the other sector by pivoting one of the sectors with respect to the other sector about the beginning point and by intersectably angling the corresponding edges defined by cuts along transfer lines; and joining the sectors after adjustment by operatively connecting the sectors to one anoter with the corresponding edges intersectably angled.

* * * * *